US009722360B2

(12) United States Patent
Yao et al.

(10) Patent No.: US 9,722,360 B2
(45) Date of Patent: Aug. 1, 2017

(54) ELECTRICAL CONNECTOR HAVING IMPROVED TERMINALS

(71) Applicant: FOXCONN INTERCONNECT TECHNOLOGY LIMITED, Grand Cayman (KY)

(72) Inventors: Tao Yao, Huaian (CN); Jing-Jie Guo, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/235,448

(22) Filed: Aug. 12, 2016

(65) Prior Publication Data

US 2017/0047689 A1 Feb. 16, 2017

(30) Foreign Application Priority Data

Aug. 12, 2015 (CN) ..... 2015 1 0491838

(51) Int. Cl.

| | |
|---|---|
| ***H01R 12/00*** | (2006.01) |
| ***H01R 13/652*** | (2006.01) |
| ***H01R 12/71*** | (2011.01) |
| ***H01R 4/02*** | (2006.01) |
| ***H01R 13/405*** | (2006.01) |

(Continued)

(52) U.S. Cl.

CPC ..... *H01R 13/652* (2013.01); *H01R 4/02* (2013.01); *H01R 12/716* (2013.01);

(Continued)

(58) Field of Classification Search

CPC H01R 13/652; H01R 12/716; H01R 2107/00; H01R 4/02; H01R 13/405;

(Continued)

(56) References Cited

U.S. PATENT DOCUMENTS 6,663,429 B1 * 12/2003 Korsunsky ..... H01R 23/688 439/108
9,022,800 B2 * 5/2015 Yang ..... H01R 13/6581 439/487

(Continued)

FOREIGN PATENT DOCUMENTS

CN 201178205 1/2009
CN 201725893 1/2011

(Continued)

*Primary Examiner* — Jean F Duverne

(74) *Attorney, Agent, or Firm* — Wei Te Chung; Ming Chieh Chang

(57) ABSTRACT

An electrical connector includes an insulative housing, a number of terminals, and a metal shell attached to the housing. The terminals have a number of grounding contacts, power contacts, and signal contacts. Each terminal has a contacting portion, an inclined portion bent forwardly from the contacting portion at a bending point, and a soldering portion. The bending points have a first bending point located at the grounding contacts, a second bending point located at the power contacts, and a third bending point located at the signal contact. A distance between the first bending points of the grounding contacts and the insertion port is larger than that between the second bending points of the power contacts and the insertion port and smaller than that between the third bending points of the signal contacts and the insertion port.

9 Claims, 10 Drawing Sheets

(51) Int. Cl.
*H01R 24/62* (2011.01)
*H01R 107/00* (2006.01)

(52) U.S. Cl.
CPC ..... *H01R 13/405* (2013.01); *H01R 24/62* (2013.01); *H01R 2107/00* (2013.01)

(58) Field of Classification Search
CPC ..... H01R 24/62; H01R 12/57; H01R 24/60; H01R 23/688; H01R 13/6581; H01R 13/6582
USPC ..... 439/83
See application file for complete search history.

(56) References Cited

U.S. PATENT DOCUMENTS

2010/0120280 A1* 5/2010 Shen ..... H01R 23/667 439/329
2015/0171574 A1* 6/2015 Little ..... H01R 24/60 439/78
2015/0200504 A1* 7/2015 Little ..... H01R 24/60 439/345
2015/0207280 A1* 7/2015 Little ..... H01R 24/60 439/607.34
2015/0229077 A1* 8/2015 Little ..... H01R 13/6582 439/78
2015/0270646 A1* 9/2015 Kao ..... H01R 13/6581 439/76.1
2016/0043512 A1* 2/2016 Kao ..... H01R 12/57 439/620.22

FOREIGN PATENT DOCUMENTS

CN 203242845 10/2013
TW 499669 4/2015
WO 2015181625 12/2015
WO 2015181629 12/2015

* cited by examiner

ELECTRICAL CONNECTOR HAVING IMPROVED TERMINALS

BACKGROUND OF THE INVENTION

1. Field of the Invention

The present invention relates to an electrical connector having improved terminals.

2. Description of Related Art

Universal Serial Bus (USB) and USB connectors are well known in the art. U.S. Patent Application Publication No. 20160118750 discloses a reversible electrical connector. The electrical connector includes a terminal module, a number of terminals retained in the terminal module, and a shell attached to the terminal module. The terminals have a number of grounding terminals, power terminals, and signal terminals. A distance between the signal terminals and the insertion port is larger than that between the other terminals and the insertion port to meet requirement of hot swap. However, a distance between the power terminals and the insertion port is same as that between the grounding terminals and the insertion port so that the power signal is disconnected followed with the grounding signal disconnected to have a bad influence to hot swap and a bad grounding function.

An improved electrical connector is desired.

SUMMARY OF THE INVENTION

Accordingly, the object of the present invention is to provide an electrical connector comprising: an insulative housing having a plurality of receiving slots located at a back-end thereof; a plurality of terminals carried by the insulative housing, the terminals having a plurality of soldering portions exposed from the insulative housing, each receiving slot being located between every two neighboring soldering portions to receive soldering material; a metallic shielding plate retained in the insulative housing; and a shielding shell attached to the insulative housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
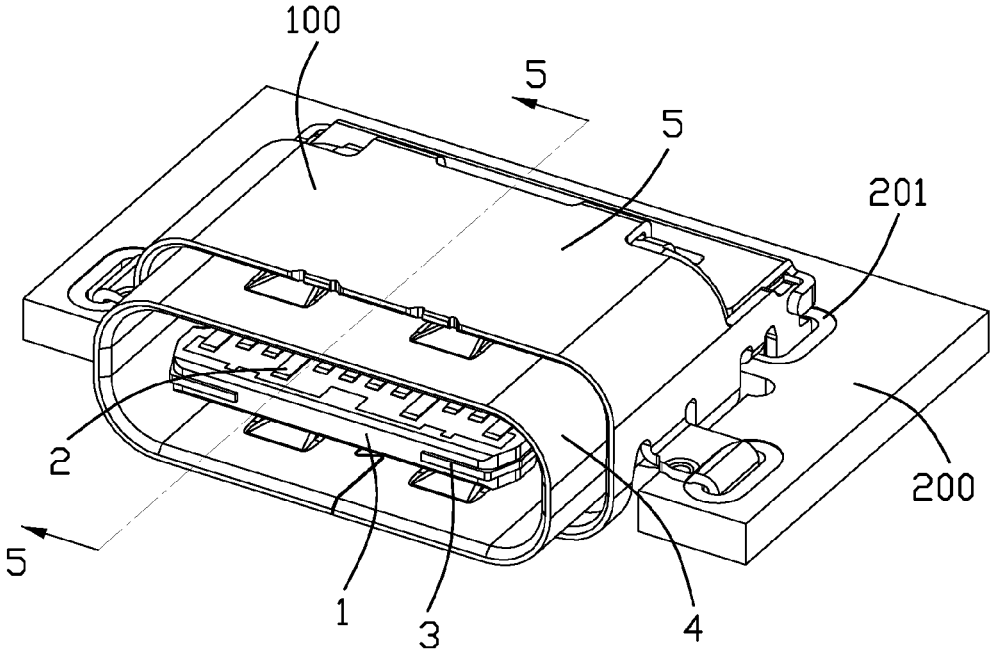
FIG. 1 is a perspective, assembled view of an electrical connector affixed to a printed circuit board.
Figure 2:
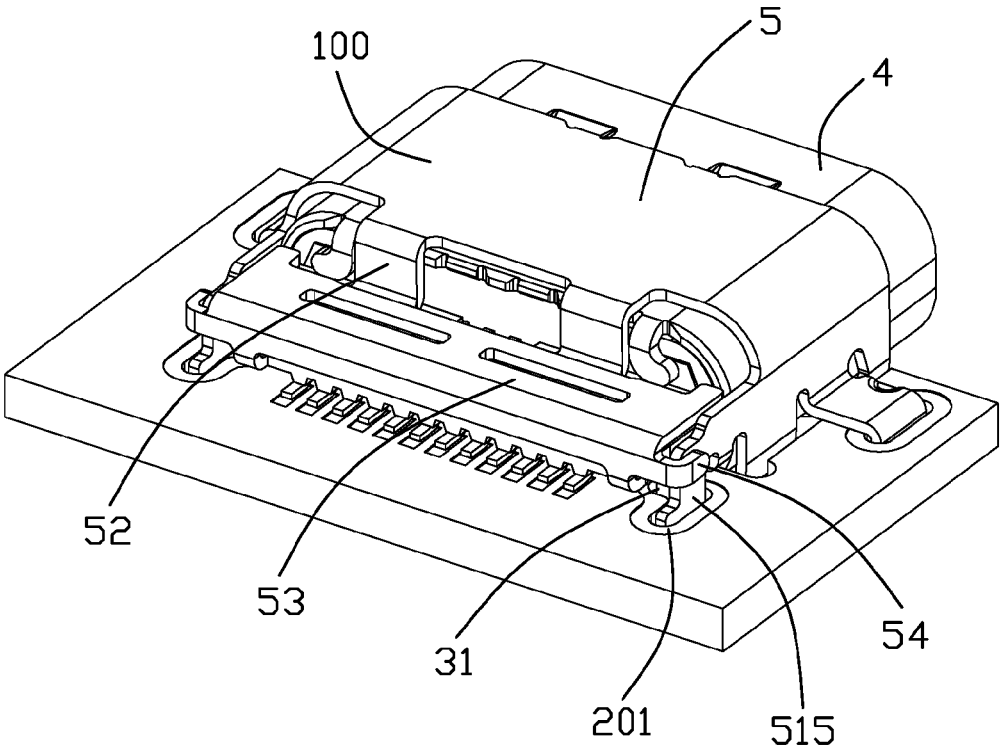
FIG. 2 is another perspective, assembled view of FIG. 1.

Reference will now be made in detail to the preferred embodiment of the present invention.

FIGS. 1 to 10 show an electrical connector 100 mounted upon a printed circuit board 200 and cooperated with a plug connector. For convenience, the electronic connector 100 defines a mating port, a mating direction, a transverse direction perpendicular to the mating direction and forming a horizontal plane therebetween, and a vertical direction perpendicular to the mating direction and the transverse direction in FIG. 1.

The electrical connector 100 includes an insulative housing 1, a number of terminals 2 and a metallic shielding plate 3 retained in the insulative housing 1, a shielding shell 4 attached to the insulative housing, and a metal shell 5 affixed to the shielding shell.

Figure 3:
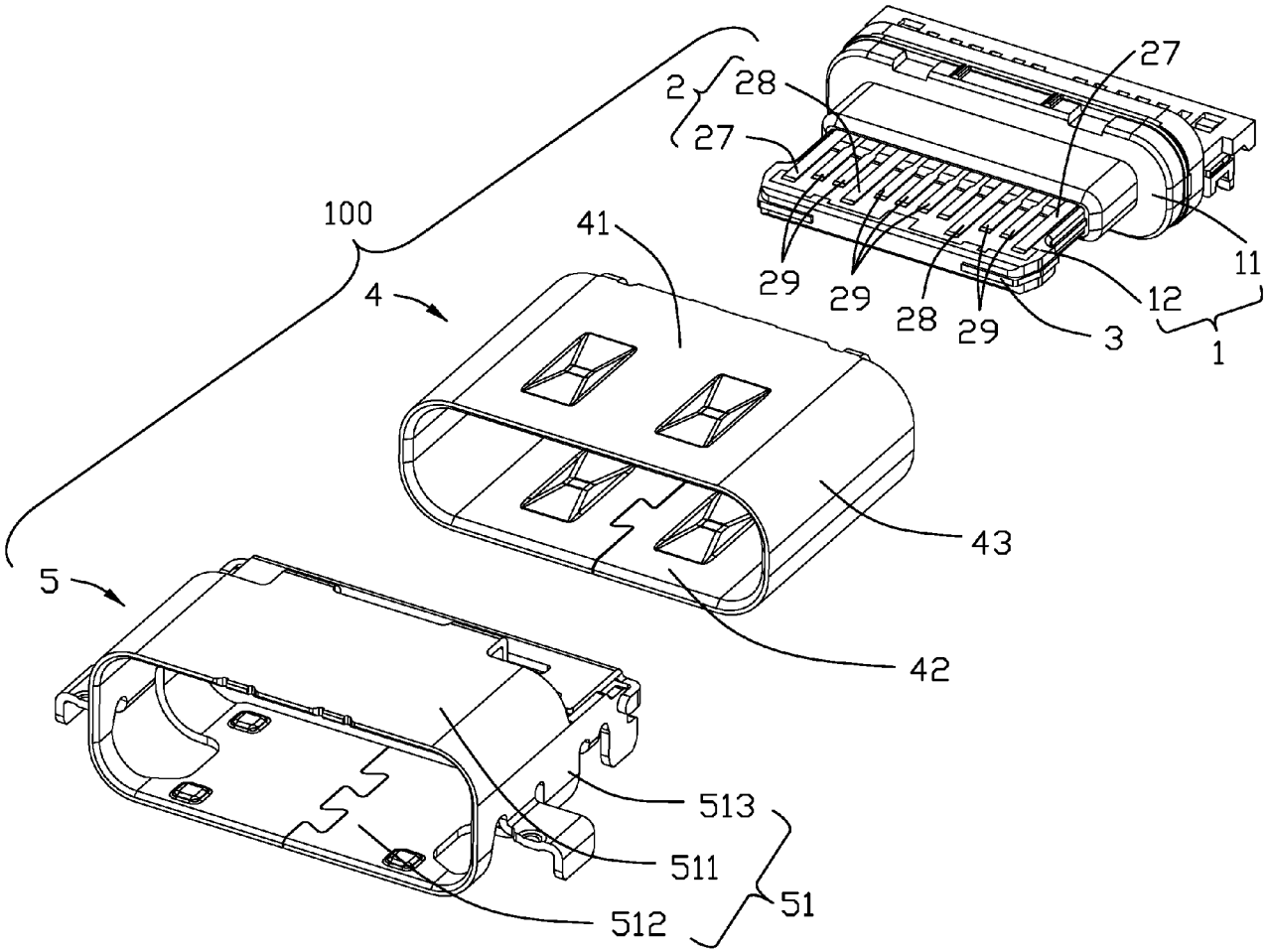
FIG. 3 is a perspective, exploded view of the electrical connector.
Figure 4:
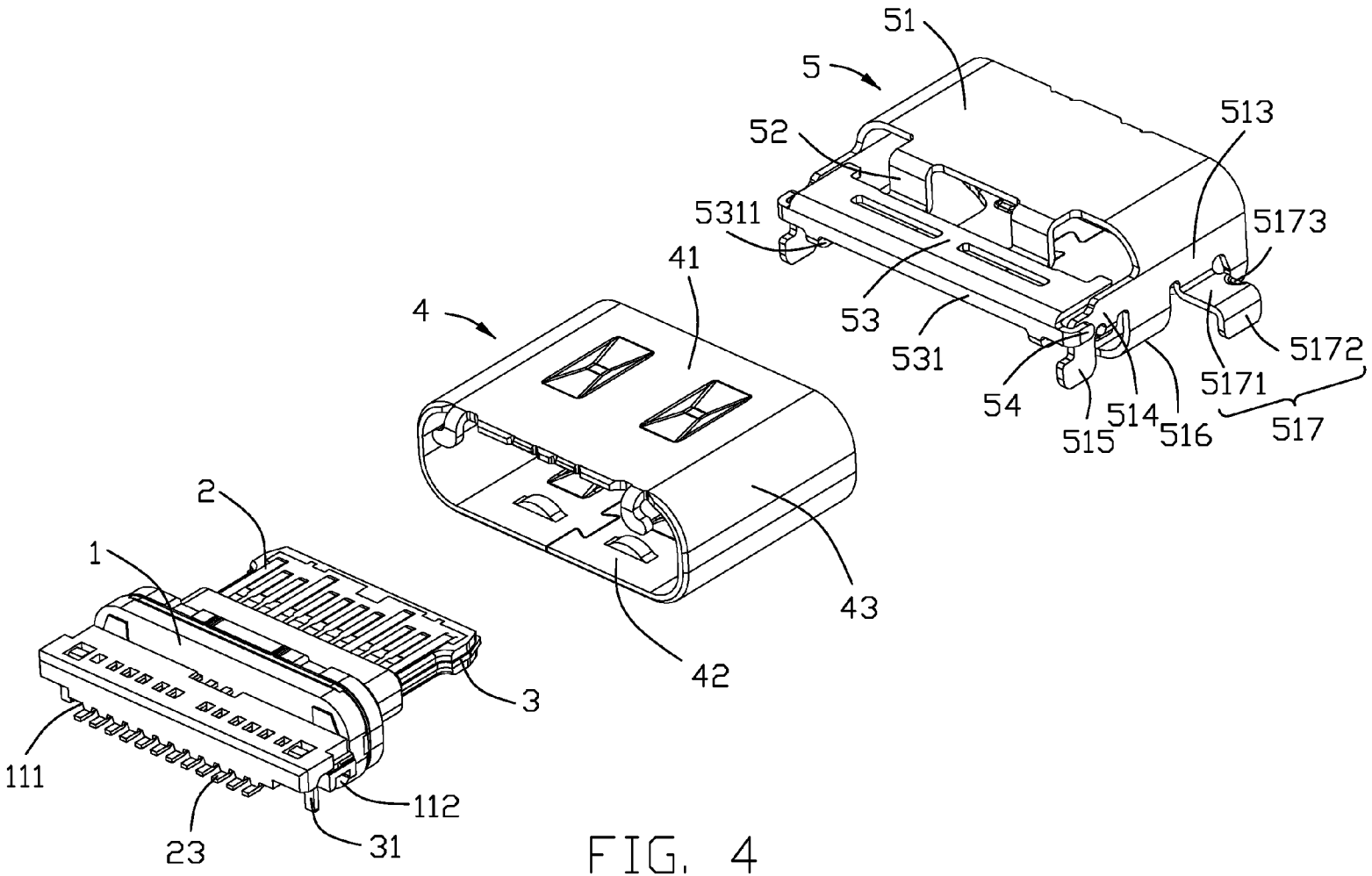
FIG. 4 is another perspective, exploded view of FIG. 3.
Figure 5:
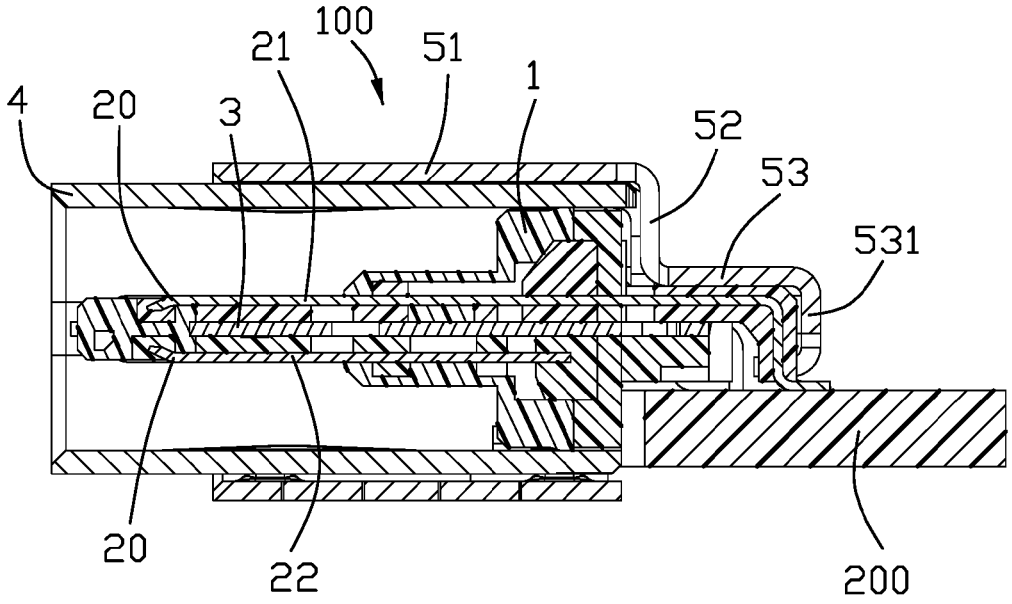
FIG. 5 is a cross-sectional view along line 5-5 in FIG. 1.
Figure 6:
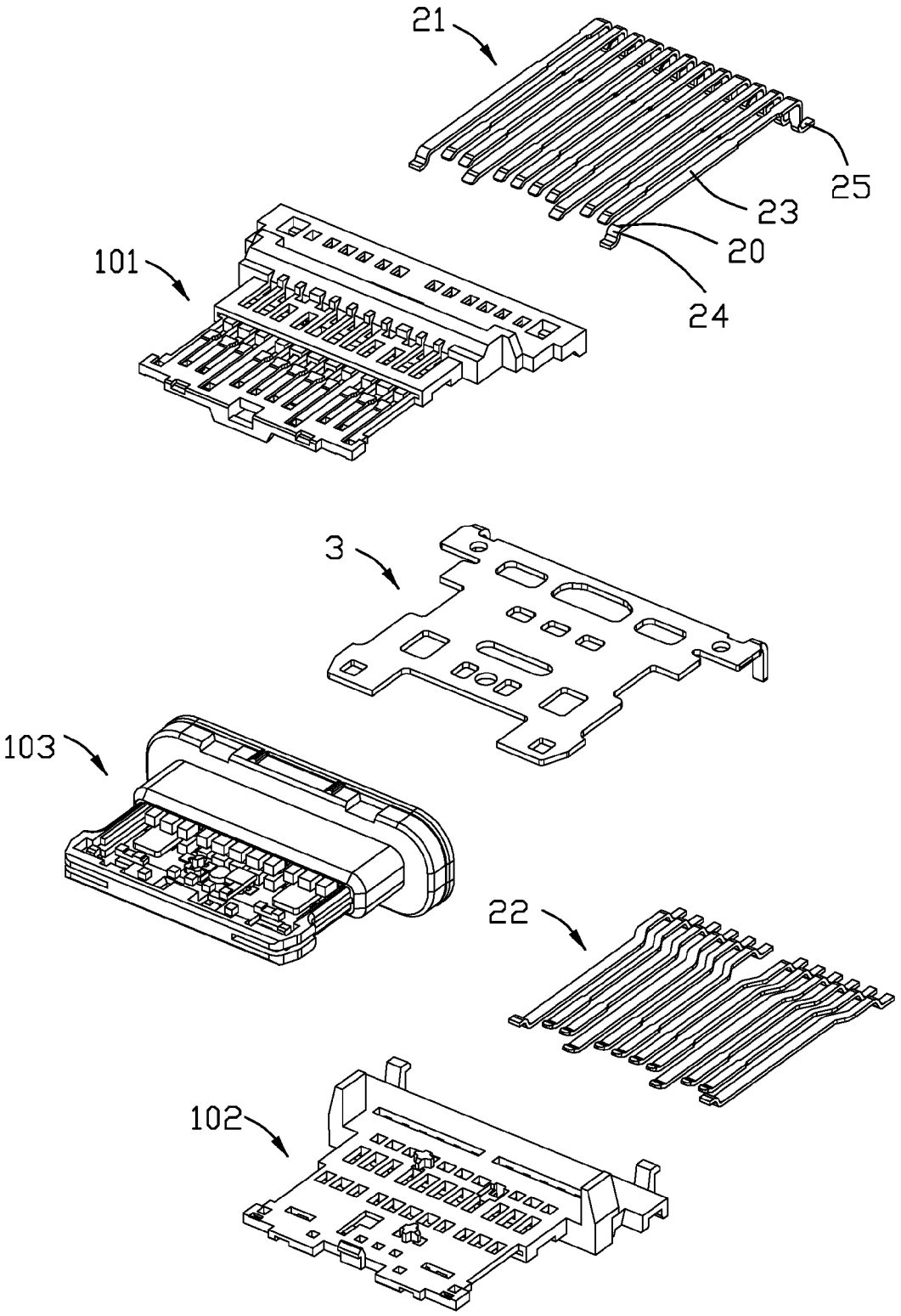
FIG. 6 is a perspective, exploded view of a number of terminals, metallic shielding plate, and an insulative housing of the electrical connector.

Referring to FIGS. 3 to 4, the insulative housing 1 includes a base portion 11 and a tongue portion 12 extending forwardly from the base portion 11. The base portion 11 has a pair of receiving slots 111 and a pair of grooves 112 located at two sides thereof. The insulative housing 1 includes a first insulative body 101, a second insulative body 102, and a third insulative body 103.

Referring to FIGS. 3 to 4, the terminals 2 include a number of first contacts 21 carried by the first insulative body 101 via an insert-molding process to form a terminal module, and a number of second contacts 22 carried by the second insulative body 102 via another insert-molding process to form another terminal module. Understandably, those two terminal modules commonly sandwich the shielding plate 3 and integrally formed with the third insulative body 103 to finalize the whole connector except the shell. The first contacts 21 and the second contacts 22 are positioned to have 180 degree symmetry such that the corresponding plug connector can be inserted and operatively coupled to the electrical connector 100 in either of two orientations. The first contacts 21 and the second contacts 22 extend in the mating direction and respectively include a pair of grounding contacts 27, a pair of power contacts 28 located forwardly and eight signal contacts 29 located backwardly. The two power contacts 28 in the middle are used to provide electric source and the two grounding contacts 27 are used for electrical grounding. The eight signal contacts 29 include four super-speed differential contacts located at two sides, two low-speed differential contacts located in the middle, and a pair of controlling contacts. Each of the first contacts 21 is associated with a respective one of the second contacts 22 and is positioned in reverse symmetry with respect to the second contacts 22.

Figure 7:
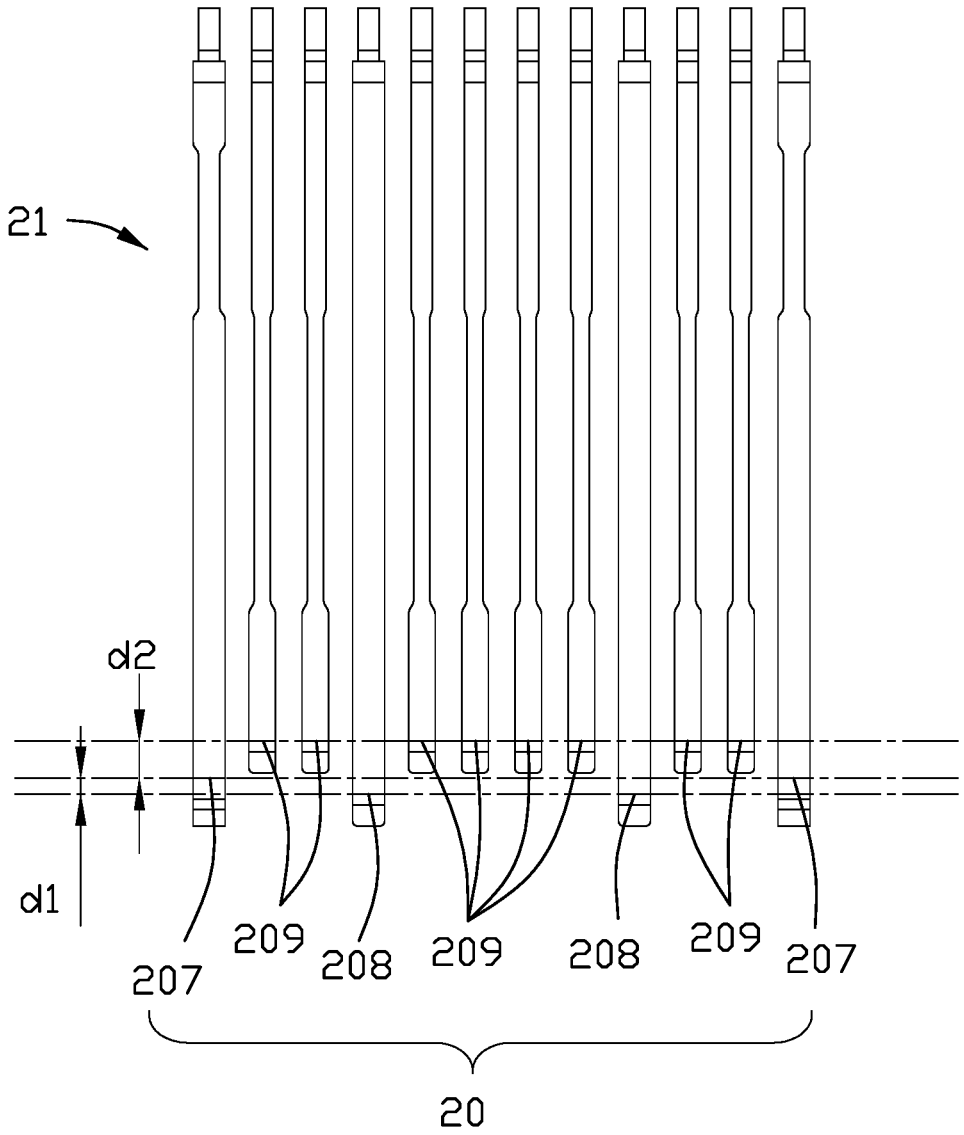
FIG. 7 is a top view of a number of first contacts.
Figure 8:
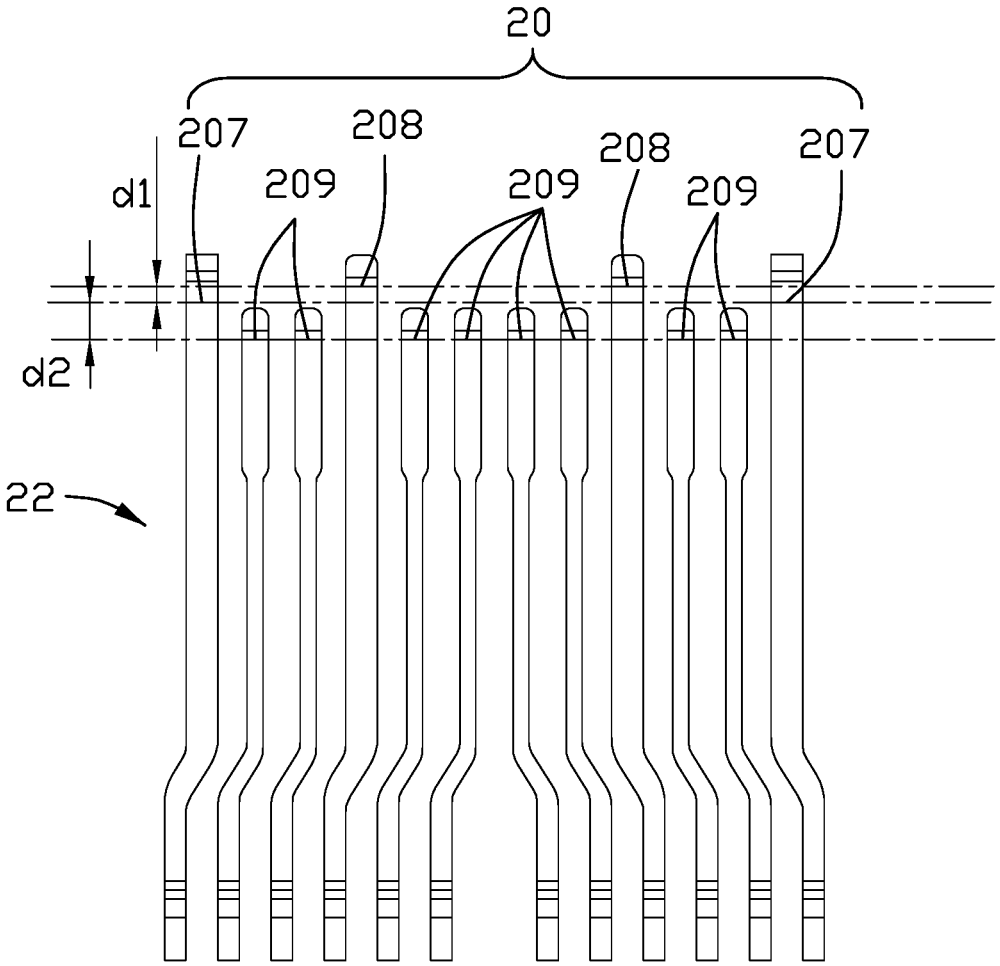
FIG. 8 is a bottom view of a number of second contacts.

Each of the terminals 2 includes a contacting portion 23 exposed from the insulative housing 1, an inclined portion 24 bent forwardly from the contacting portion 23 at a bending point 20 and retained in the insulative housing 1, and a soldering portion 25 extending backwardly from the contacting portion 23 and soldered on the printed circuit board 200. The bending points 20 have a pair of first bending points 207 defined in the grounding contacts 27, a pair of second bending point 208 defined in the power contacts 28, and a number of third bending points 209 defined in the signal contacts 29. A distance between the first bending points 207 of the grounding contacts 27 and the mating port is larger than that between the second bending points 208 of the power contacts 28 and the mating port and smaller than that between the third bending points 209 of the signal contacts 29 to meet the requirement of hot swap and improve manufacture procedure. Referring to FIG. 7 and FIG. 8, the first bending points 207 of the grounding contacts 27 and the second bending points 208 of the power contacts 28 define a first distance d1 therebetween along the mating direction. The first bending points 207 of the grounding contacts 27 and the third bending points 209 of the signal contacts 29 define a second distance d2 therebetween along the mating direction. In a preferred embodiment, the first bending points 207 of the grounding contacts 27 is backward about 0.2 mm compared to the second bending points 208 of the power contacts 28 along the mating direction, in another word, d1 is 0.2 mm.

Figure 9:
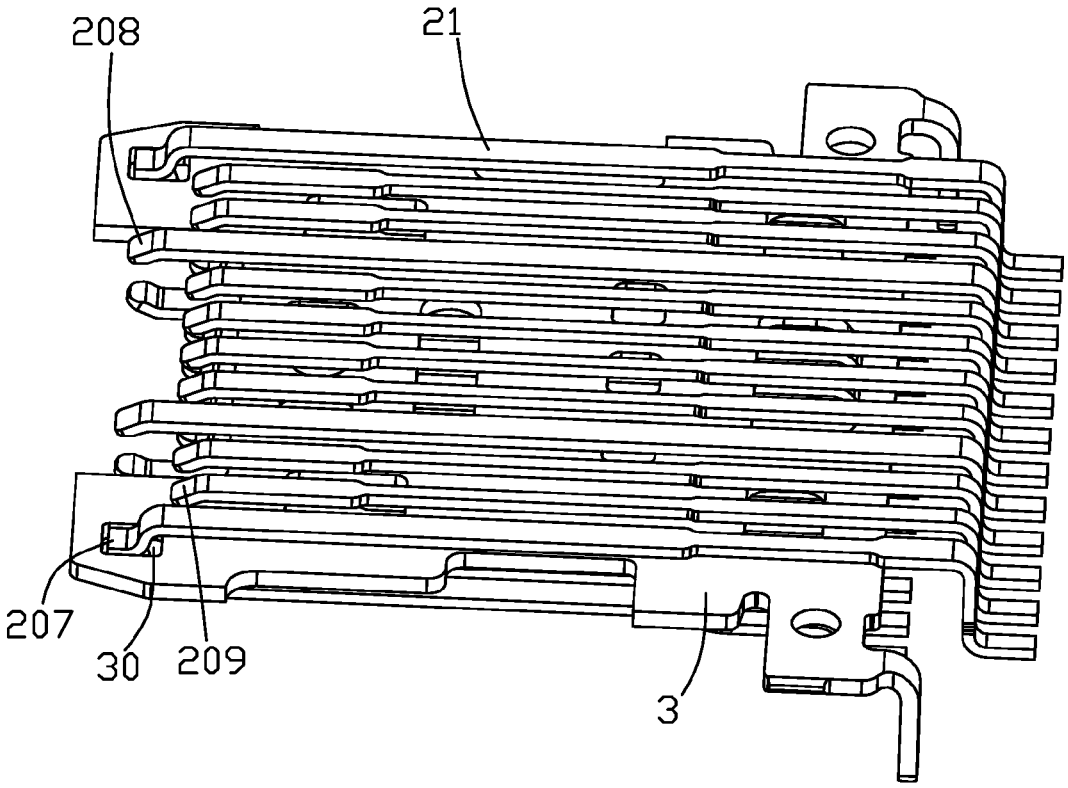
FIG. 9 is a perspective, assembled view of the terminals and a metallic shielding shell.
Figure 10:
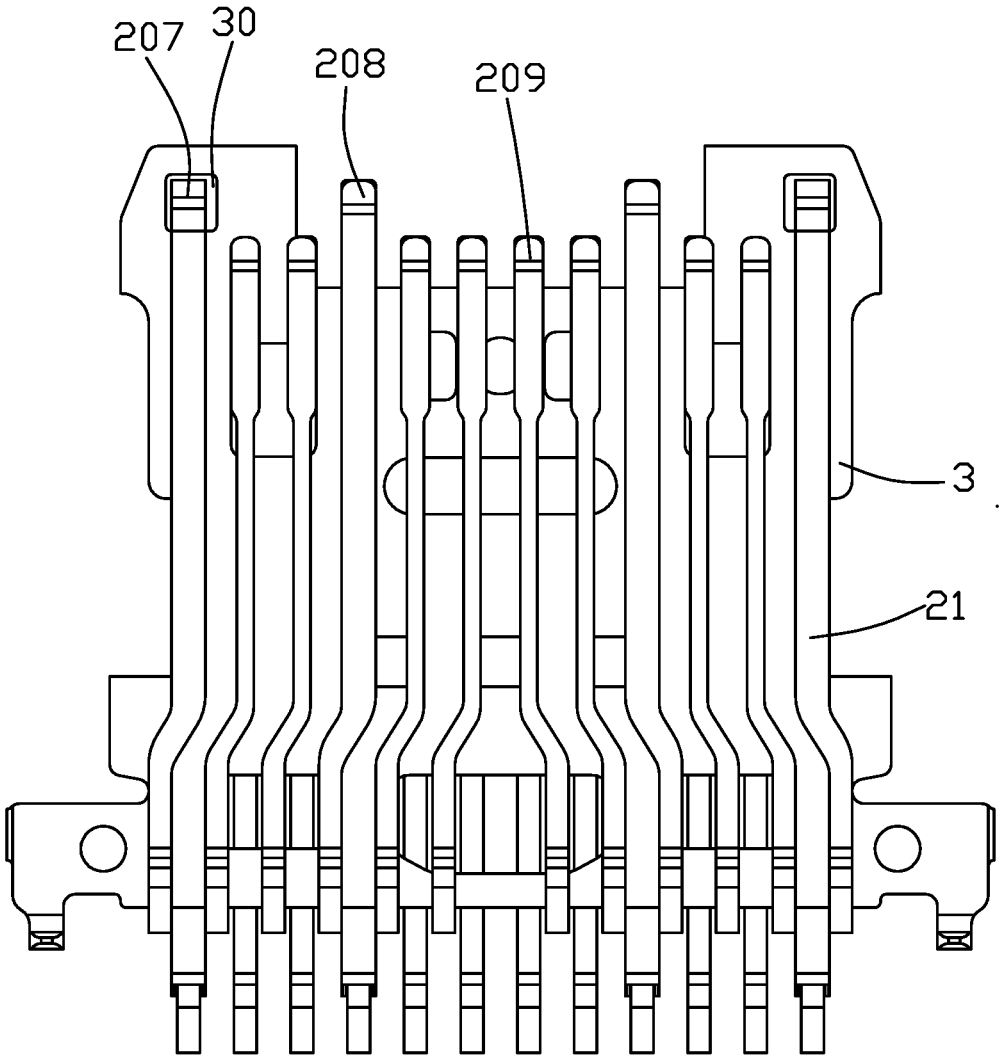
FIG. 10 is a top view of a number of FIG. 9.

Referring to FIGS. 3 to 6, the metallic shielding plate 3 is sandwiched between the first insulative housing 101 receiving the first contacts 21 and the second insulative housing 102 receiving the second contacts 22 and has a pair of soldering legs 31 bent downwardly from a rear end thereof. Referring to FIGS. 9 to 10, the metallic shielding shell 3 has a pair of holding holes 30 to receive the inclined portions 24 of the grounding contacts 27 of the first contacts 21 and the second contacts 22. The inclined portions 24 of the grounding contacts 27 of the first contacts 21 and the second contacts 22 contact with each other along the vertical direction.

Referring to FIGS. 1 to 5, the shielding shell 4 includes a top wall 41 and a bottom wall 42 located oppositely, and a pair of side walls 43 connected with the top wall 41 and the bottom wall 42. The shielding shell 4 is located in the metal shell 5 and a front end thereof is exposed from the metal shell 5.

Referring to FIGS. 1 to 5, the metal shell 5 has a main portion 51, a connecting portion 52 bent downwardly from a rear end of the main portion 51, a shielding wall 53 bent backwardly from a bottom end of the connecting portion 52, and a pair of affixed arms 54 extending forwardly from two sides of the shielding wall 53. The main portion 51 defines an upper surface 511, a lower surface 512, a pair of side surface 513 connected with the upper surface 511 and the lower surface 512, a pair of lateral wall 514 extending backwardly from the side surfaces 513 and located beside the shielding wall 53. The lateral wall 514 is resisted against by the affixed arms 54. The shielding wall 53 has a rear wall 531 extending downwardly from a rear end thereof and a pair of affixed portion 5311 extending forwardly from a bottom end of the rear wall 531 and received in the receiving slots 111. The affixed arms 54 are bent forwardly from two sides of the rear wall 531 and extend outside the lateral walls 514.

Referring to FIGS. 1 to 5, the lateral wall 514 of the metal shell 5 includes a pair of first soldering sections 515 extending downwardly therefrom. The soldering legs 31 of the metallic shielding shell 3 are close to the first soldering sections 515 and beyond adjoining the first soldering sections 515. As the electrical connector 100 is soldered to the printed circuit board 200, the first soldering sections 515 and the soldering legs 31 in a same side are received in a same hole 201 of the printed circuit board 200 and soldered with the metal layer of the holes 201 to ground. The lateral walls 514 have a pair of resisting portion 516 extending inwardly from a pair of rear end thereof and received in the grooves 112 of the insulative housing 1. The affixed arms 54 are located above the first soldering sections 515 along the vertical direction.

Referring to FIGS. 1 to 5, the side surfaces 513 have a pair of second soldering sections 517. Each second soldering section 517 includes a panel portion 5171 extending from the side surface 513 and a vertical portion 5172 extending downwardly from the panel portion 5171. The panel portion 5171 has a dimple 5173 close to the insertion port and protruding downwardly to avoid bary-centre unstable. The second soldering section 517 is located at middle of the electrical connector 100 along the mating direction.

In other embodiment, the affixed arms 54 are bent downwardly from two sides of the shielding wall 53 and extend outside the lateral wall 514. The affixed arms 54 are located above the first soldering sections 515.

In assembly, the main portion 51 of the metal shell 5 encloses the shielding shell 4, then the connecting portion 52 and the shielding wall 53 are formed, and finally the affixed arms 54 resisting the lateral wall 514, the affixed portions 5311 received in the receiving slots 111, and the resisting portions 516 received in the grooves 112 are formed.

However, the disclosure is illustrative only, changes may be made in detail, especially in matter of shape, size, and arrangement of sections within the principles of the invention.

What is claimed is:

1. An electrical connector, defining an insertion port, a mating direction, a transverse direction perpendicular to the mating direction, and a vertical direction perpendicular to the mating direction and the transverse direction, comprising:

an insulative housing;

a plurality of terminals retained in the insulative housing, the terminals having a plurality of grounding contacts, power contacts, and signal contacts, each terminal having a contacting portion exposed from the insulative housing, an inclined portion bent forwardly from the contacting portion at a bending point and retained in the insulative housing, and a soldering portion extending backwardly, the bending points of the terminals having first bending points located at the grounding contacts, second bending points located at the power contacts, and third bending points located at the signal contacts, a distance between the first bending points of the grounding contacts and the insertion port being larger than that between the second bending points of the power contacts and the insertion port and smaller than that between the third bending points of the signal contacts and the insertion port; and a metal shell attached to the insulative housing; a metallic shielding plate retained in the insulative housing, and wherein the metal shell has a main portion, a connecting portion bent downwardly from a rear end of the main portion, a shielding wall bent backwardly from a bottom end of the connecting portion, and a pair of affixed arms extending forwardly from two sides of the shielding wall, the main portion defines an upper surface, a lower surface, a pair of side surfaces connected with the upper surface and the lower surface, and a pair of lateral wall extending backwardly from the side surfaces and located beside the shielding wall, and the affixed arms are resisted against by the lateral walls; wherein the lateral wall of the metal shell includes a pair of first soldering sections extending downwardly therefrom, the metallic shielding plate has a pair of soldering legs, the soldering legs are close to the first soldering sections and beyond adjoining the first soldering sections, and the affixed arms are located above the first soldering sections along the vertical direction; wherein the side surfaces have a pair of second soldering sections, each second soldering section includes a panel portion extending from the side surface and a vertical portion extending downwardly from the panel portion, and the panel portion has a dimple close to the insertion port and protruding downwardly; a shielding shell located in the metal shell, a front end of the shielding shell being exposed from the metal shell.

2. The electrical connector as claimed in claim 1, wherein the first bending point is located behind the second bending point away from the insertion port, and the first bending points and the second bending points define a distance at 0.2 mm.

3. The electrical connector as claimed in claim 1, wherein the shielding wall has a rear wall extending downwardly from a rear end thereof and the affixed arms are bent forwardly from two sides of the rear wall and extend outside the lateral walls.

4. The electrical connector as claimed in claim 3, wherein said insulative housing has a pair of receiving slots, the shielding wall has a pair of affixed portion extending forwardly from a bottom end of the rear wall and received in the receiving slots.

5. The electrical connector as claimed in claim 1, wherein the affixed arms are bent downwardly from two sides of the shielding wall and extend outside the lateral wall.

6. The electrical connector as claimed in claim 5, wherein the insulative housing has a pair of grooves, and the lateral walls have a pair of resisting portions extending inwardly from a pair of rear end thereof and received in the grooves of the insulative housing.

7. An electrical connector comprising:

a pair of terminal modules sandwiching a metallic shielding plate therebetween in a vertical direction, each of said terminal modules including a plurality of contacts embedded within an insulator via an insert-molding process and arranged with one another along a transverse direction perpendicular to said vertical direction, each of said contacts including a front contacting section and a rear soldering section along a front-to-section direction perpendicular to both said vertical direction and said transverse direction, and an inclined section located at a front end of the contacting section and angled at a bending point therebetween;

said contacts including signal contacts, power contacts and grounding contacts; wherein the inclined sections of the power contacts and the grounding contacts extend forwardly beyond those of the signal contacts in said front-to-back direction, and the bending points of the grounding contacts are located between those of the power contacts and those of the signal contacts along the front-to-back direction in a side view; wherein the inclined sections of the grounding contacts in one of said terminal modules are mechanically and electrically connected to those of the corresponding grounding contacts of the other of said terminal modules in said vertical direction; wherein said shielding plate includes an opening in which the inclined sections of the grounding contacts of said one of the terminal modules are connected with those of the corresponding grounding contacts of the other of the terminal modules in the vertical direction.

8. The electrical connector as claimed in 7, further including a metallic shielding shell enclosing said pair of terminal modules and said shielding plate, wherein a metallic main shell is attached upon the shielding shell and defines a Z-shaped rear wall to cover a rear side of the whole connector.

9. An electrical connector comprising:

a pair of terminal modules sandwiching a metallic shielding plate therebetween in a vertical direction, each of said terminal modules including a plurality of contacts embedded within an insulator via an insert-molding process and arranged with one another along a transverse direction perpendicular to said vertical direction, each of said contacts including a front contacting section and a rear soldering section along a front-to-section direction perpendicular to both said vertical direction and said transverse direction, and an inclined section located at a front end of the contacting section and angled at a bending point therebetween;

said contacts including signal contacts, power contacts and grounding contacts; wherein the shielding plates forms an opening in which the inclined section of the grounding contact in one of said pair of terminal modules is mechanically and electrically connected to that of the corresponding grounding contact in the other of said pair of terminal modules in said vertical direction; wherein another insulator is applied upon said pair of terminal modules to fill said opening so as to secure said inclined sections of said grounding contacts in said opening; wherein the bending point of the grounding contact is closely aligned with an end of the opening of the shielding plate in the vertical direction.

* * * * *